US007514623B1

(12) United States Patent
Spinler et al.

(10) Patent No.: US 7,514,623 B1
(45) Date of Patent: Apr. 7, 2009

(54) MUSIC PERFORMANCE CORRELATION AND AUTONOMIC ADJUSTMENT

(75) Inventors: Amy J. Spinler, Rochester, MN (US); Megan E. Williams, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/163,428

(22) Filed: Jun. 27, 2008

(51) Int. Cl.
*G10H 7/00* (2006.01)
*A63B 71/00* (2006.01)

(52) U.S. Cl. ..... 84/612; 482/9

(58) Field of Classification Search ..... 84/612; 482/3–9, 900, 901; 700/94
See application file for complete search history.

(56) References Cited

U.S. PATENT DOCUMENTS

2006/0107822 A1* 5/2006 Bowen ..... 84/612
2007/0074618 A1* 4/2007 Vergo ..... 84/612
2007/0118043 A1 5/2007 Oliver et al.
2007/0213110 A1 9/2007 Rosenberg

* cited by examiner

*Primary Examiner*—Jeffrey Donels
(74) *Attorney, Agent, or Firm*—Cantor Colburn LLP

(57) ABSTRACT

Methods, systems and computer program products for music performance correlation and autonomic adjustment. Exemplary embodiments include a method for music performance correlation and autonomic adjustment, the method including providing a set of musical pieces during an activity having associated performance parameters, tracking the associated performance parameters during reception of the set of musical pieces, in response to an increase of the associated performance parameters, identifying a subset of musical pieces of the set of musical pieces, analyzing musical elements of the subset of musical pieces, generating a correlation between the performance parameters and the musical elements, selecting an additional subset of musical pieces having the musical elements of the subset of musical pieces and in response to a decrease of the associated performance parameters, providing at least one of the subset of musical pieces and the additional subset of musical pieces.

1 Claim, 2 Drawing Sheets

MUSIC PERFORMANCE CORRELATION AND AUTONOMIC ADJUSTMENT

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND

1. Field of the Invention

This invention relates to performance tracking, and particularly to methods, systems and computer program products for music performance correlation and autonomic adjustment.

2. Description of Background

Music has an emotional and physical effect on humans, either positive or negative. One example is athletic performance. Runners may have several devices to track performance, including but not limited to a heart rate monitor, an audio (mp3) player, and a GPS unit that tracks workout speed, distance, and location. Real-time data on speed, distance, and heart rate is collected and can be analyzed after the workout for trends to correct performance issues. However, there lacks an ability to track a song that was played at times of peak or decreased performance other than through manually tracking which song is playing at what time.

SUMMARY

Exemplary embodiments include a method for music performance correlation and autonomic adjustment, the method including providing a set of musical pieces during an activity having associated performance parameters, tracking the associated performance parameters during reception of the set of musical pieces, in response to an increase of the associated performance parameters, identifying a subset of musical pieces of the set of musical pieces, analyzing musical elements of the subset of musical pieces, generating a correlation between the performance parameters and the musical elements, selecting an additional subset of musical pieces having the musical elements of the subset of musical pieces and in response to a decrease of the associated performance parameters, providing at least one of the subset of musical pieces and the additional subset of musical pieces, wherein the musical elements includes at least one of tempo, beat, rhythm, meter pitch, timbre, accent, phrasing, dynamics, melody, texture, harmony, form and lyrical factors.

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution which provides the ability to track performance based on music selection thereby enabling identification of music to help increase performance. In areas where performance data can be recorded, the effect of music on performance can be measured and used to increase performance. In addition, the solution provides the ability to adjust songs in real time based on performance data which provides performance gains. By adjusting music during an activity, the performance gains are immediate rather than delayed through trial and error over many timeframes. In addition, performance is increased indirectly, rather than explicitly by the user. As such, music has an affect on performance, and the solution provides the ability to: 1) correlate performance increases and decreases to specific music 2) autonomically adjust real-time music selection to increase performance.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION

Exemplary embodiments include methods, systems and computer program products having the ability to track performance data for a specific song, for correlation with peak and decreased performance, and adjust which songs are playing based on real time data to increase performance. By tracking performance based on music selection, music can be identified to help increase performance. Performance-enhancing songs are unique to each individual, and can be discovered only through trial and error, and correlating with performance data. As such, music identified as performance-enhancing can be used to identify other similar songs that may enhance performance. For example, a song with 120 beats per minute may not increase performance for one person, but may increase performance for another person. Music can then be analyzed for the correct beats per minute to identify other performance, thereby enhancing songs to be tried. Other factors for analyzing music include: genre of music (rock, pop, country), lyrics (key words, subject, lack of words), tempo changes, beats matching heart rate or stride, etc. In exemplary embodiments, correlating music and performance allows for real-time music adjustment to increase performance. By adjusting songs in real-time based on performance data, performance gains are obtained instantly. By adjusting music during an activity, the performance gains are immediate rather than delayed through trial and error over many timeframes. In addition, performance is increased indirectly, rather than explicitly by the user. Besides athletic performance, there are many other applications of music performance tracking and autonomic adjustment. Music can be used to increase performance of office workers. Typing mistakes and lines of code created can be measured and correlated to music that is played, and performance-enhancing music can be played when performance is decreasing. Music can also be used to increase performance of truck drivers (e.g., keep them awake). Swerving, heavy eyelids, and hand movements can be tracked and correlated to what music is playing, with performance-enhancing music played when the driver is getting drowsy.

Figure 1:
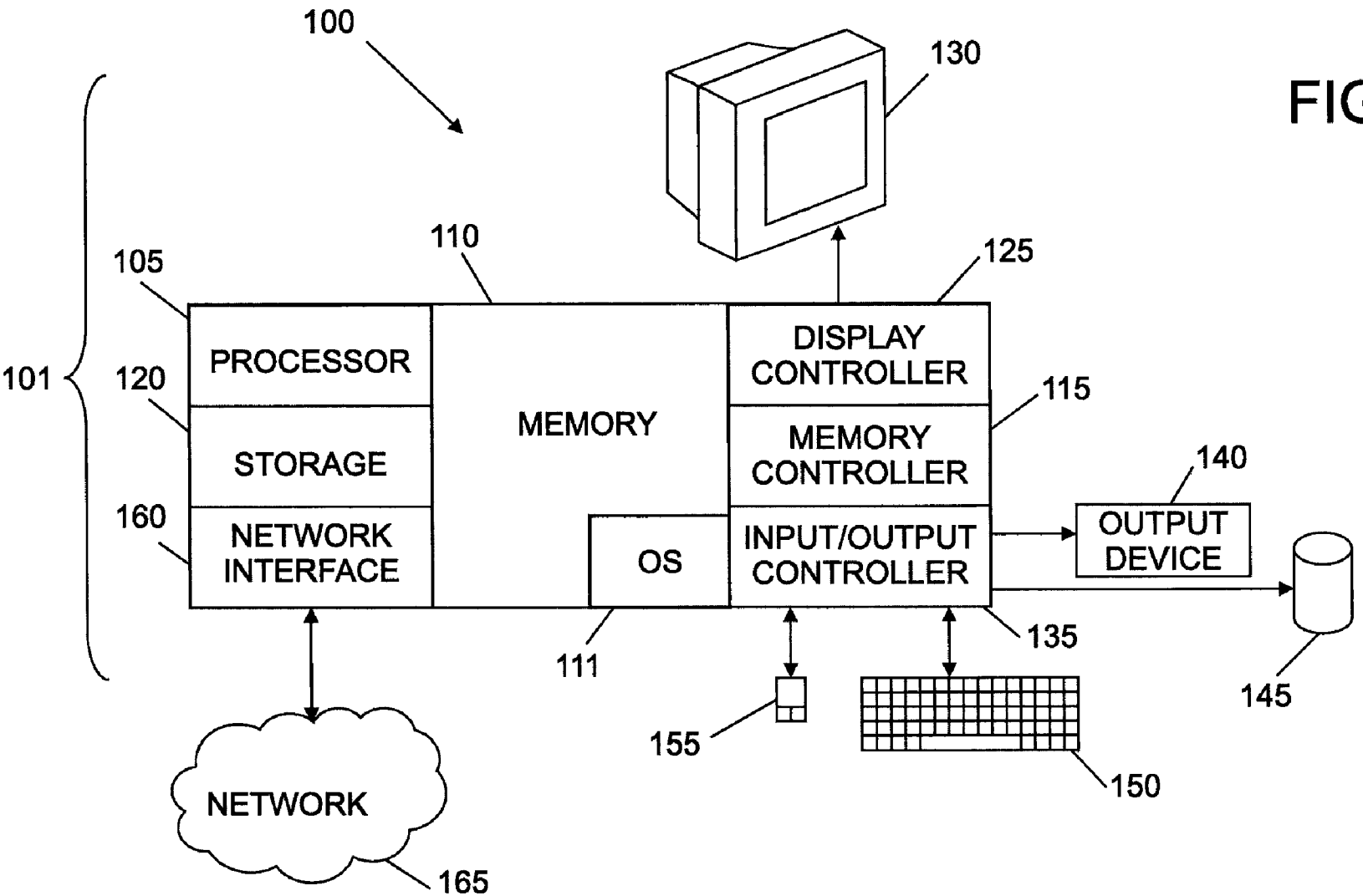
FIG. 1 illustrates an exemplary embodiment of a system for music performance correlation and autonomic adjustment.

FIG. 1 illustrates an exemplary embodiment of a system 100 for music performance correlation and autonomic adjustment. The methods described herein can be implemented in software (e.g., firmware), hardware, or a combination thereof. In exemplary embodiments, the methods described herein are implemented in software, as an executable program, and is executed by a special or general-purpose digital computer, such as a personal computer, workstation, minicomputer, or mainframe computer. The system 100 therefore includes general-purpose computer 101.

In exemplary embodiments, in terms of hardware architecture, as shown in FIG. 1, the computer 101 includes a processor 105, memory 110 coupled to a memory controller 115, and one or more input and/or output (I/O) devices 140, 145 (or peripherals) that are communicatively coupled via a local input/output controller 135. The input/output controller 135 can be, for example but not limited to, one or more buses or other wired or wireless connections, as is known in the art. The input/output controller 135 may have additional elements, which are omitted for simplicity, such as controllers, buffers (caches), drivers, repeaters, and receivers, to enable communications. Further, the local interface may include address, control, and/or data connections to enable appropriate communications among the aforementioned components.

The processor 105 is a hardware device for executing software, particularly that stored in memory 110. The processor 105 can be any custom made or commercially available processor, a central processing unit (CPU), an auxiliary processor among several processors associated with the computer 101, a semiconductor based microprocessor (in the form of a microchip or chip set), a macroprocessor, or generally any device for executing software instructions.

The memory 110 can include any one or combination of volatile memory elements (e.g., random access memory (RAM, such as DRAM, SRAM, SDRAM, etc.)) and nonvolatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory 110 may incorporate electronic, magnetic, optical, and/or other types of storage media. Note that the memory 110 can have a distributed architecture, where various components are situated remote from one another, but can be accessed by the processor 105.

The software in memory 110 may include one or more separate programs, each of which comprises an ordered listing of executable instructions for implementing logical functions. In the example of FIG. 1, the software in the memory 110 includes the performance correlation and autonomic adjustment methods described herein in accordance with exemplary embodiments and a suitable operating system (OS) 111. The operating system 111 essentially controls the execution of other computer programs, such the performance correlation and autonomic adjustment systems and methods described herein, and provides scheduling, input-output control, file and data management, memory management, and communication control and related services.

The performance correlation and autonomic adjustment methods described herein may be in the form of a source program, executable program (object code), script, or any other entity comprising a set of instructions to be performed. When a source program, then the program needs to be translated via a compiler, assembler, interpreter, or the like, which may or may not be included within the memory 110, so as to operate properly in connection with the OS 111. Furthermore, the performance correlation and autonomic adjustment methods can be written as an object oriented programming language, which has classes of data and methods, or a procedure programming language, which has routines, subroutines, and/or functions.

In exemplary embodiments, a conventional keyboard 150 and mouse 155 can be coupled to the input/output controller 135. Other output devices such as the I/O devices 140, 145 may include input devices, for example but not limited to a printer, a scanner, microphone, and the like. Finally, the I/O devices 140, 145 may further include devices that communicate both inputs and outputs, for instance but not limited to, a network interface card (NIC) or modulator/demodulator (for accessing other files, devices, systems, or a network), a radio frequency (RF) or other transceiver, a telephonic interface, a bridge, a router, and the like. The system 100 can further include a display controller 125 coupled to a display 130. In exemplary embodiments, the system 100 can further include a network interface 160 for coupling to a network 165. The network 165 can be an IP-based network for communication between the computer 101 and any external server, client and the like via a broadband connection. The network 165 transmits and receives data between the computer 101 and external systems. In exemplary embodiments, network 165 can be a managed IP network administered by a service provider. The network 165 may be implemented in a wireless fashion, e.g., using wireless protocols and technologies, such as WiFi, WiMax, etc. The network 165 can also be a packet-switched network such as a local area network, wide area network, metropolitan area network, Internet network, or other similar type of network environment. The network 165 may be a fixed wireless network, a wireless local area network (LAN), a wireless wide area network (WAN) a personal area network (PAN), a virtual private network (VPN), intranet or other suitable network system and includes equipment for receiving and transmitting signals.

If the computer 101 is a PC, workstation, intelligent device or the like, the software in the memory 110 may further include a basic input output system (BIOS) (omitted for simplicity). The BIOS is a set of essential software routines that initialize and test hardware at startup, start the OS 111, and support the transfer of data among the hardware devices. The BIOS is stored in ROM so that the BIOS can be executed when the computer 101 is activated.

When the computer 101 is in operation, the processor 105 is configured to execute software stored within the memory 110, to communicate data to and from the memory 110, and to generally control operations of the computer 101 pursuant to the software. The performance correlation and autonomic adjustment methods described herein and the OS 111, in whole or in part, but typically the latter, are read by the processor 105, perhaps buffered within the processor 105, and then executed.

When the systems and methods described herein are implemented in software, as is shown in FIG. 1, it the methods can be stored on any computer readable medium, such as storage 120, for use by or in connection with any computer related system or method. In the context of this document, a computer readable medium is an electronic, magnetic, optical, or other physical device or means that can contain or store a computer program for use by or in connection with a computer related system or method. The performance correlation and autonomic adjustment methods described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In exemplary embodiments, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, or semiconductor system, apparatus, or device. More specific examples (a non-exhaustive list) of the computer-readable medium would include the following: a portable computer diskette (magnetic), a random access memory (RAM) (electronic), a read-only memory (ROM) (electronic), an erasable programmable read-only memory (EPROM, EEPROM, or Flash memory) (electronic), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In exemplary embodiments, where the performance correlation and autonomic adjustment methods are implemented in hardware, the performance correlation and autonomic adjustment methods described herein can implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

In exemplary embodiments, in order to provide music performance correlation and autonomic adjustment, the system 100 can provide: 1) Data collection; 2) identification of performance-enhancing musical pieces (e.g., songs); 3) analysis of performance enhancing songs; and 4) delivery of performance enhancing music in response to a loss of performance in subsequent activities.

In exemplary embodiments, during data collection, the subject listens to music as they normally would during their activities. For example, an athlete would have GPS data (e.g., speed, distance) and heart rate are tracked as usual, in addition to what song is playing at which point in the workout. During identification of performance-enhancing songs, the system 100 identifies performance-enhancing songs through correlations on what song was playing during times of increased performance (e.g., an increase in performance parameters (e.g., increased speed, desired heart rate)). During analysis of performance-enhancing songs, the system 100 analyzes songs that increase performance for the basic elements of music, which can include, but are not limited to tempo, beat, rhythm, meter pitch, timbre, accent, phrasing, dynamics, melody, texture, harmony, form and lyrical factors (e.g., key words, subject matter, lack of words). In addition, similar songs are identified to enhance performance in subsequent workouts. In a discovery phase, the system implements the performance-enhancing music during subsequent activities or in response to decreased performance (i.e., a decrease in performance parameters). If performance is decreasing (e.g., heart rate down, speed down) the performance-enhancing songs are automatically played, rather than random music. This process can be repeated as many times as necessary. It is appreciated that performance enhancing songs can also change for an individual. As such, repetition of the above-described process is desired.

It is appreciated that the a process providing the methods described herein may be included on portable audio devices, performance tracking devices or computing devices used to collect performance data and upload/download songs to a portable audio device (e.g., the computer 101). It is also appreciated that the process may be distributed across the aforementioned devices.

Figure 2:
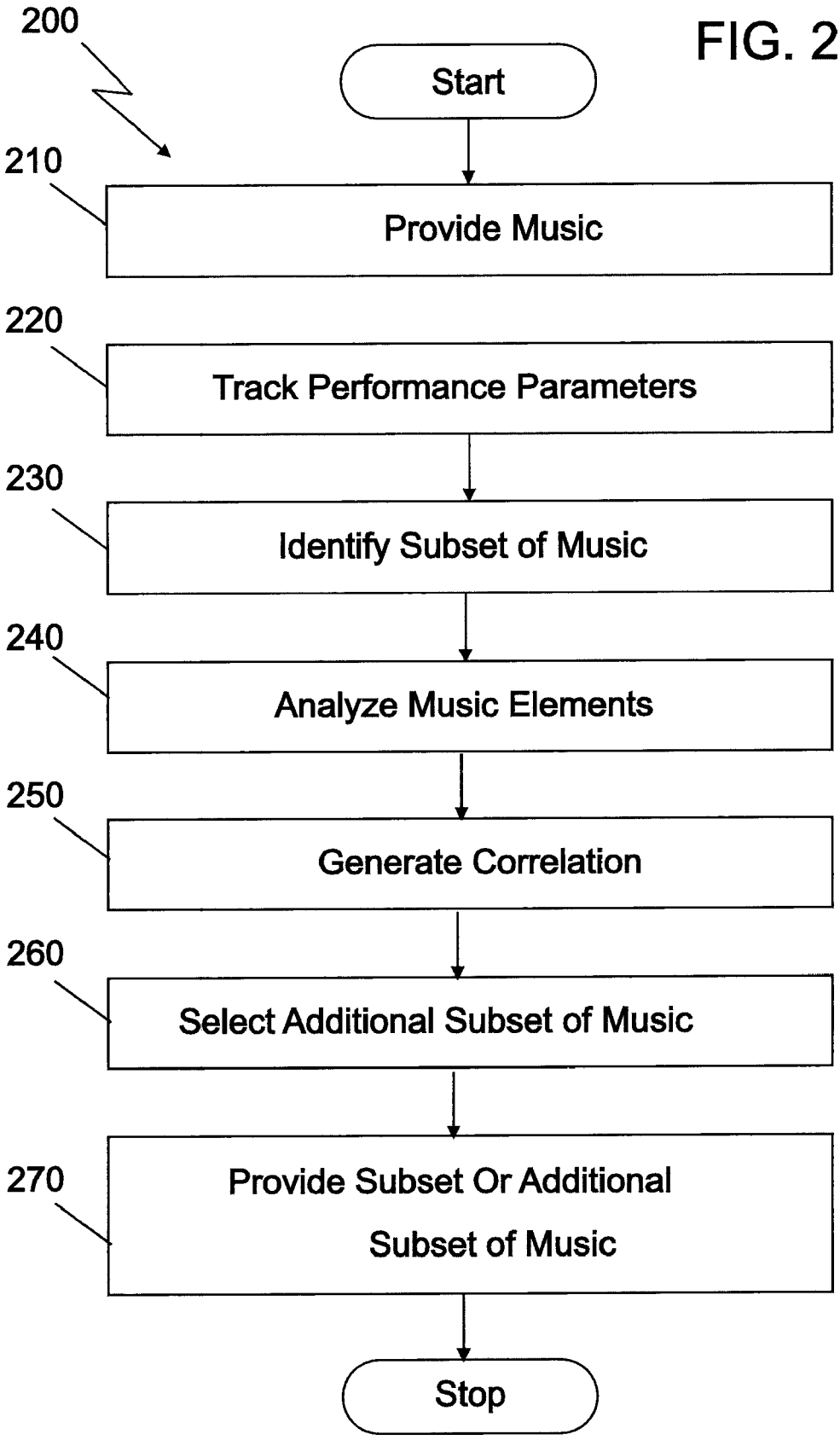
FIG. 2 illustrates a flow chart of a method for music performance correlation and autonomic adjustment in accordance with exemplary embodiments.

FIG. 2 illustrates a flow chart of a method 200 for music performance correlation and autonomic adjustment in accordance with exemplary embodiments. At block 210, the system 100 provides a set of musical pieces during an activity having associated performance parameters. At block 220, the system tracks the associated performance parameters during reception of the set of musical pieces. At block 230, in response to an increase of the associated performance parameters, the system 100 identifies a subset of musical pieces of the set of musical pieces. At block 240, the system analyzes musical elements of the subset of musical pieces. In exemplary embodiments, the musical elements can include, but are not limited to: tempo, beat, rhythm, meter pitch, timbre, accent, phrasing, dynamics, melody, texture, harmony, form and lyrical factors. At block 250, the system 100 generates a correlation between the performance parameters and the musical elements. At block 260, the system 100 selects an additional subset of musical pieces having the musical elements of the subset of musical pieces. At block 270, in response to a decrease of the performance parameters, the system 100 provides at least one of the subset of musical pieces and the additional subset of musical pieces.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A computer-readable medium having a computer-readable program code embodied therein, said computer readable program code adapted to be executed to implement a method for music performance correlation and autonomic adjustment, the method consisting of:

providing a set of musical pieces during an activity having associated performance parameters;

tracking the associated performance parameters during reception of the set of musical pieces;

in response to an increase of the associated performance parameters, identifying a subset of musical pieces of the set of musical pieces;

analyzing musical elements of the subset of musical pieces;

generating a correlation between the performance parameters and the musical elements;

selecting an additional subset of musical pieces having the musical elements of the subset of musical pieces; and in response to a decrease of the associated performance parameters, providing at least one of the subset of musical pieces and the additional subset of musical pieces, wherein the musical elements includes at least one of tempo, beat, rhythm, meter pitch, timbre, accent, phrasing, dynamics, melody, texture, harmony, form and lyrical factors.

* * * * *